US009701495B2

(12) United States Patent
Ito

(10) Patent No.: US 9,701,495 B2
(45) Date of Patent: Jul. 11, 2017

(54) SHEET FEEDING APPARATUS

(71) Applicant: Toshiyuki Ito, Yamanashi-ken (JP)

(72) Inventor: Toshiyuki Ito, Yamanashi-ken (JP)

(73) Assignee: NISCA CORPORATION, Minamikoma-gun, Yamanashi-ken (JP)

( * ) Notice: Subject to any disclaimer, the term of this patent is extended or adjusted under 35 U.S.C. 154(b) by 0 days.

(21) Appl. No.: 14/978,618

(22) Filed: Dec. 22, 2015

(65) Prior Publication Data

US 2016/0185539 A1 Jun. 30, 2016

(30) Foreign Application Priority Data

Dec. 26, 2014 (JP) ..... 2014-265315

(51) Int. Cl.

| | |
|---|---|
| ***B65H 1/00*** | (2006.01) |
| ***B65H 1/14*** | (2006.01) |
| ***B65H 3/06*** | (2006.01) |
| ***B65H 7/02*** | (2006.01) |

(52) U.S. Cl.

CPC ..... *B65H 1/14* (2013.01); *B65H 3/06* (2013.01); *B65H 7/02* (2013.01); *B65H 2402/5441* (2013.01); *B65H 2403/51* (2013.01); *B65H 2403/544* (2013.01); *B65H 2405/1142* (2013.01); *B65H 2405/15* (2013.01); *B65H 2511/13* (2013.01); *B65H 2515/30* (2013.01)

(58) Field of Classification Search

CPC .... B65H 9/10; B65H 9/101; B65H 2405/114; B65H 2405/1142; B65H 2405/11425; B65H 2405/1144; B65H 2405/12; B65H 2405/13; B65H 2405/15; B65H 2511/00; B65H 2511/10; B65H 2511/12; B65H 2511/13; B65H 2515/30; B65H 2403/51; B65H 2403/544; B65H 2402/5441

USPC ..... 271/171

See application file for complete search history.

(56) References Cited

U.S. PATENT DOCUMENTS

| | | | | |
|---|---|---|---|---|
| 5,292,116 | A * | 3/1994 | Inoue | B65H 1/04 271/157 |
| 6,279,900 | B1 * | 8/2001 | Yamagishi | B65H 5/38 271/186 |
| 6,883,799 | B2 * | 4/2005 | Matsuki | B65H 1/04 271/145 |
| 7,912,384 | B2 * | 3/2011 | Dan | G03G 15/6564 271/121 |
| 8,083,232 | B2 * | 12/2011 | deJong | B65H 5/062 271/273 |
| 8,191,892 | B2 * | 6/2012 | Fuda | B65H 1/04 271/171 |

(Continued)

FOREIGN PATENT DOCUMENTS

| | | |
|---|---|---|
| JP | 2000-118730 A | 4/2000 |
| JP | 2001-192124 A | 7/2001 |

*Primary Examiner* — Prasad Gokhale
(74) *Attorney, Agent, or Firm* — Manabu Kanesaka

(57) ABSTRACT

The present invention is to provide a sheet feeding apparatus to feed a sheet including a pressing member that presses and regulates one end in the width direction of sheets on a stack tray, an urging member that urges the pressing member, and an urging force changing mechanism that changes an urging force of the urging member in accordance with a sheet thickness, the urging force changing mechanism provides a pressing force in accordance with a sheet kind, so that sheets can be reliably aligned and fed in an appropriate posture.

11 Claims, 13 Drawing Sheets

(56) References Cited

U.S. PATENT DOCUMENTS

| | | | | |
|---|---|---|---|---|
| 9,540,193 | B2 * | 1/2017 | Fukumoto | B65H 1/12 |
| 2003/0075857 | A1 * | 4/2003 | Matsuki | B65H 1/04<br>271/162 |
| 2010/0148430 | A1 * | 6/2010 | Fuda | B65H 1/04<br>271/241 |
| 2012/0119434 | A1 * | 5/2012 | Ueda | B65H 1/04<br>271/147 |
| 2016/0001994 | A1 * | 1/2016 | Kuwata | B65H 1/266<br>271/153 |
| 2016/0334747 | A1 * | 11/2016 | Wakabayashi | B65H 1/24 |

* cited by examiner

SHEET FEEDING APPARATUS

RELATED APPLICATIONS

The present application is based on, and claims priority from, Japanese Application No. JP2014-265315 filed Dec. 26, 2014, the disclosure of which is hereby incorporated by reference herein in its entirety.

BACKGROUND OF THE INVENTION

1. Field of the Invention

The present invention relates to a sheet feeding apparatus, and in particular, relates to a configuration for aligning sheets stacked on a stack tray.

2. Description of Related Arts

Traditionally, there has been known a sheet feeding apparatus that feeds a sheet to an image forming portion of an image forming apparatus such as a copying machine and a printer. In such a sheet feeding apparatus, a sheet on a stack tray is drawn by a drawing roller, and the drawn sheet is separated one by one at a separating portion that includes a sheet feeding roller and a separating member and is fed to the image forming portion of the image forming apparatus. Thus, an image is formed on a sheet at the image forming portion.

There have been known a sheet feeding apparatus including a sheet feeding cassette capable of storing about a hundred sheets, a sheet feeding apparatus including a storage chamber capable of storing a number of sheets such as several thousand sheets, and the like. Further, a sheet feeding apparatus includes a feeding roller that feeds a sheet as being contacted to an uppermost face of sheets and a separating mechanism that separates the fed sheet one by one. Here, a sheet stacked on a sheet feeding cassette or in a storage chamber is fed by the feeding roller and separated by the separating mechanism one by one, and then, the sheet is fed to the image forming portion.

In some sheet cassettes or storage chambers of sheet feeding apparatuses, a movable regulating plate is arranged to align sheets before the sheets are fed. The movable regulating plate is arranged at one end side in a sheet width direction, while a fixed regulating plate serving as a positional reference in the sheet width direction is arranged at the other end side in the sheet width direction. The movable regulating plate is elastically supported by a spring and the spring causes the movable regulating plate to urge an end part of stacked sheets in the width direction with a predetermined urging force. The sheets are moved toward the fixed regulating plate by the urging force of the movable regulating plate and aligned with the other end part of the sheets being pressed toward the fixed regulating plate. Further, the movable regulating plate, in cooperation with the fixed regulating plate, guides an end part in the width direction of the sheets fed by the feeding roller to prevent sheet skewing from occurring.

Here, when the urging force of the movable regulating plate is too large, sheets are bent and feeding malfunction is caused. When the urging force thereof is too small, sheet skewing is caused. Accordingly, the urging force of the movable regulating plate is set based on experiments and the like to have an appropriate constant value that prevent a problem from occurring with general regular paper.

Recently, it has been desired that sheets for a sheet feeding apparatus are to be diversified in kinds. With a traditional structure to apply a constant urging force to the movable regulating plate, there arise a problem of feeding malfunction due to sheet bending depending on basis weight of stacked sheets when stacked sheets are reduced in quantity, and a problem of feeding malfunction due to sheet skewing. Since thick paper having large sheet basis weight is hard and heavy, large urging force is required to be aligned. However, since thin paper having small sheet basis weight is soft, sheets are bent when the urging force is enlarged. Consequently, there arises a problem that sheets cannot be aligned.

SUMMARY OF THE INVENTION

According to a sheet feeding apparatus including a pressing member that presses and regulates one end in the width direction of sheets stacked on a stack tray, an urging member that urges the pressing member, and an urging force changing mechanism that changes an urging force of the urging member in accordance with a sheet thickness, sheets can be reliably aligned in the width direction and fed in an appropriate posture to prevent sheet feeding malfunction.

DESCRIPTION OF THE PREFERRED EMBODIMENTS

Figure 1:
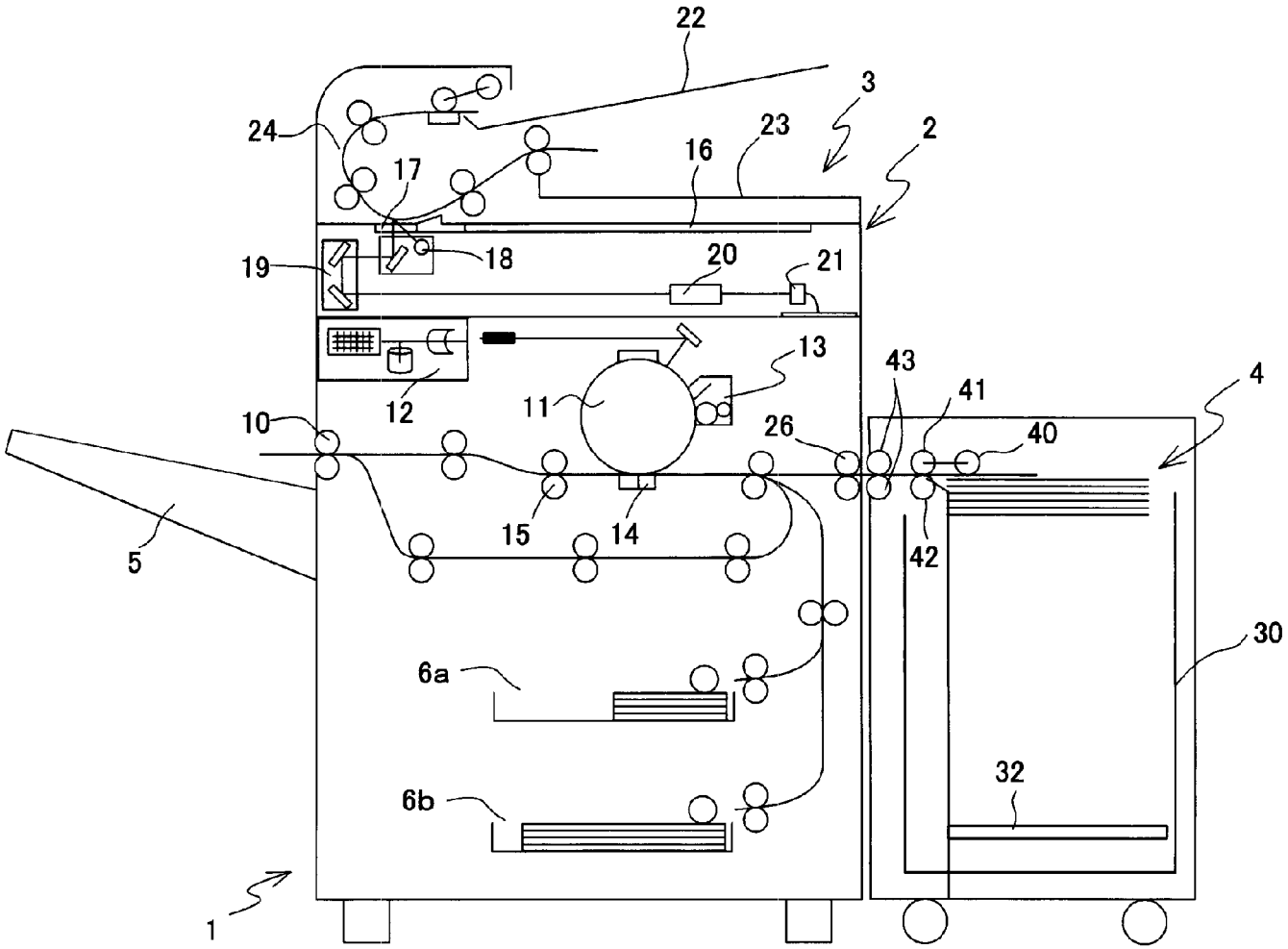
FIG. 1 is a view illustrating an overall structure of an image forming system that includes a sheet feeding apparatus.

FIG. 1 is a view illustrating an overall structure of an image forming system that includes a sheet feeding apparatus. As illustrated in FIG. 1, the image forming system includes an image forming apparatus 1 that prints an image on a sheet, a document reading apparatus 2 that reads a document, a document feeding apparatus 3 that conveys a document to a reading portion of the document reading apparatus 2, a sheet feeding apparatus 4 that feeds a sheet to the image forming apparatus 1, and a sheet stacking apparatus 5 that stacks sheets discharged from the image forming apparatus 1 as being connected to a discharging port of the image forming apparatus 1.

The image forming apparatus 1 includes two sheet feeding cassettes 6*a*, 6*b* capable of storing about a hundred sheets. Here, a sheet is taken from any one of the two sheet feeding cassettes 6*a*, 6*b* and the sheet feeding apparatus 4, image data transferred from the document reading apparatus 2 is printed on the taken sheet, and the sheet is discharged to the sheet stacking apparatus 5 by a sheet discharging roller pair 10.

The image forming apparatus 1 performs electrostatic printing. The image forming apparatus 1 includes a beam transmitting unit 12 that forms an electrostatic latent image on a photoconductive drum 11, a developing unit 13 that transfers toner ink on the electrostatic latent image, and a transferring charger 14. The ink image formed on the photoconductive drum 11 is transferred on a sheet by the transferring charger 14. The image on the sheet is heated and fixed by a fixing roller 15 that is arranged at the downstream side thereof. Then, the sheet is conveyed to the sheet stacking apparatus 5.

The sheet feeding apparatus 4 includes a storing portion (storage chamber) 30 capable of storing about three thousands of sheets having a larger capacity than capacities of the sheet feeding cassettes 6*a*, 6*b* and supplies sheets one by one to the image forming apparatus 1 in accordance with a sheet feeding command from the image forming apparatus 1.

The document reading apparatus 2 is provided with a first platen 16 and a second platen 17 that are formed of clear glass arranged horizontally in parallel at an upper part of the document reading apparatus 2. The first platen 16 is used for reading a manually-set document and is formed to have dimensions being matched to a usable maximum-sized document. The second platen 17 is used for reading a document that is moved at a predetermined velocity.

First and second reading carriages 18, 19 and a photoelectric conversion device including a collecting lens 20 and a photoelectric conversion element (CCD) 21 are arranged in the document reading apparatus 2. The first and second reading carriages 18, 19 are driven by an unillustrated carriage motor to be reciprocated in a sub-scanning direction below the first platen 16. The first reading carriage 18 includes a lamp that emits light toward a document and a mirror that reflects light reflected from the document. The second reading carriage 19 includes two mirrors that guide the light from the first reading carriage 18 to the collecting lens 20 and the photoelectric conversion element 21. A document set on the first platen 16 is read by being irradiated with light while the first and second reading carriages 18, 19 are moved and photoelectrically-converting the reflected light from the document with the photoelectric conversion element 21. Image data of the document read by the photoelectric conversion element 21 is transferred as an image signal to the beam transmitting unit 12 of the image forming apparatus 1.

In the document feeding apparatus 3, a document conveying mechanism 24 causes a document set on a document tray 22 to pass through the second platen 17 and to be discharged to a document discharge tray 23. When a document passing on the second platen 17 caused by the document feeding apparatus 3 is to be read, the first and second reading carriages 18, 19 read the passing document while staying below the second platen 17.

Figure 2:
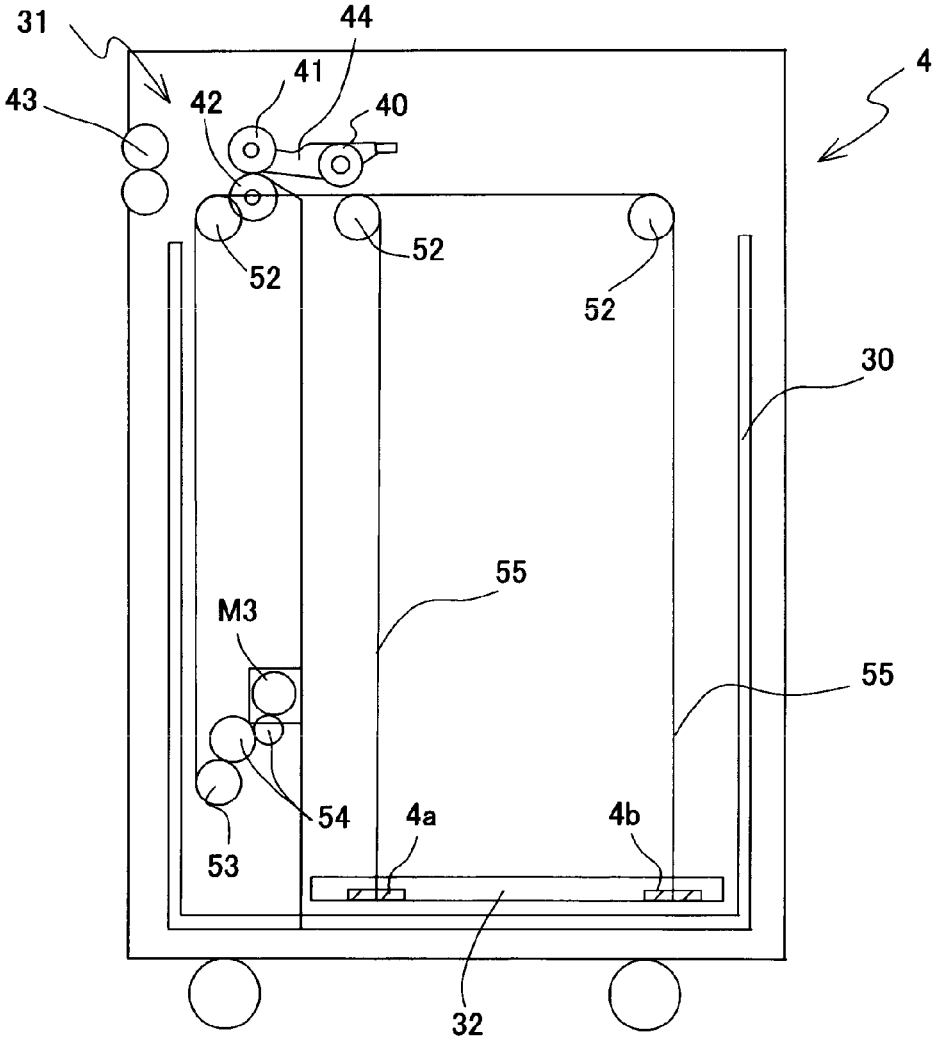
FIG. 2 is a sectional view illustrating the sheet feeding apparatus.
Figure 3:
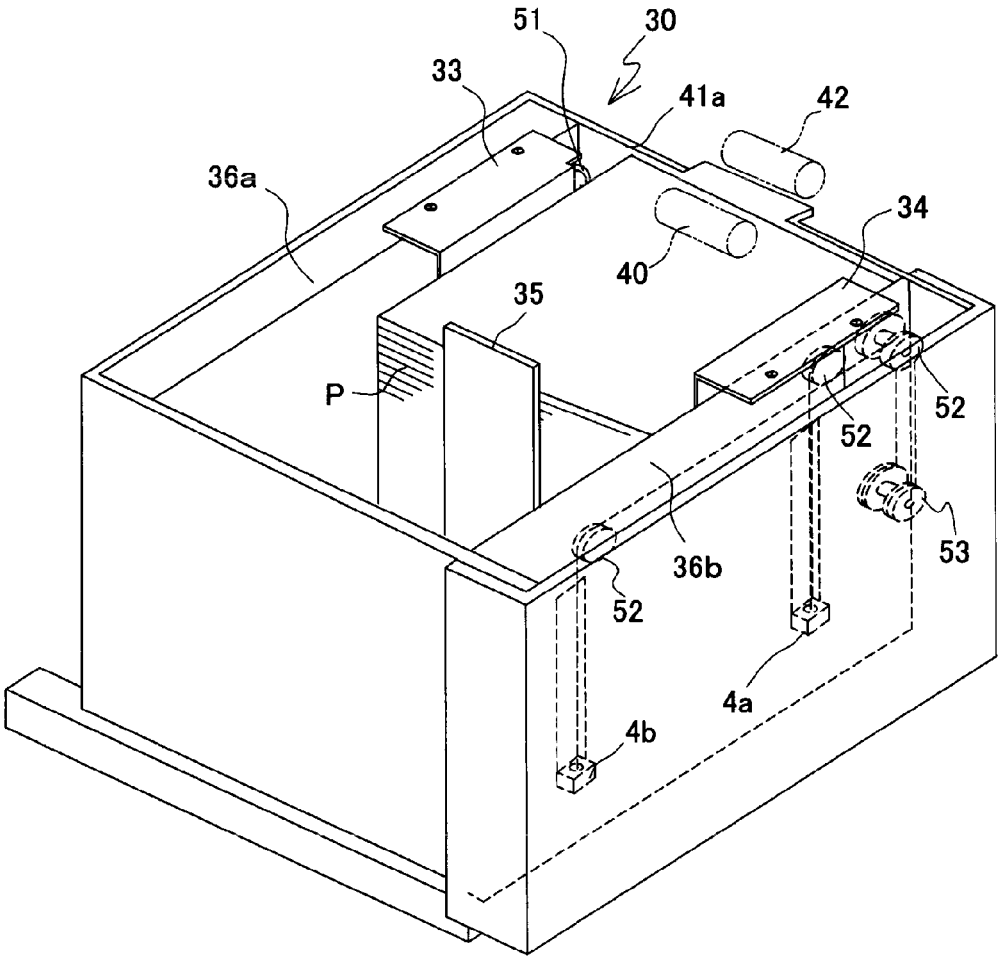
FIG. 3 is a perspective view illustrating a storage chamber of the sheet feeding apparatus.
Figure 4:
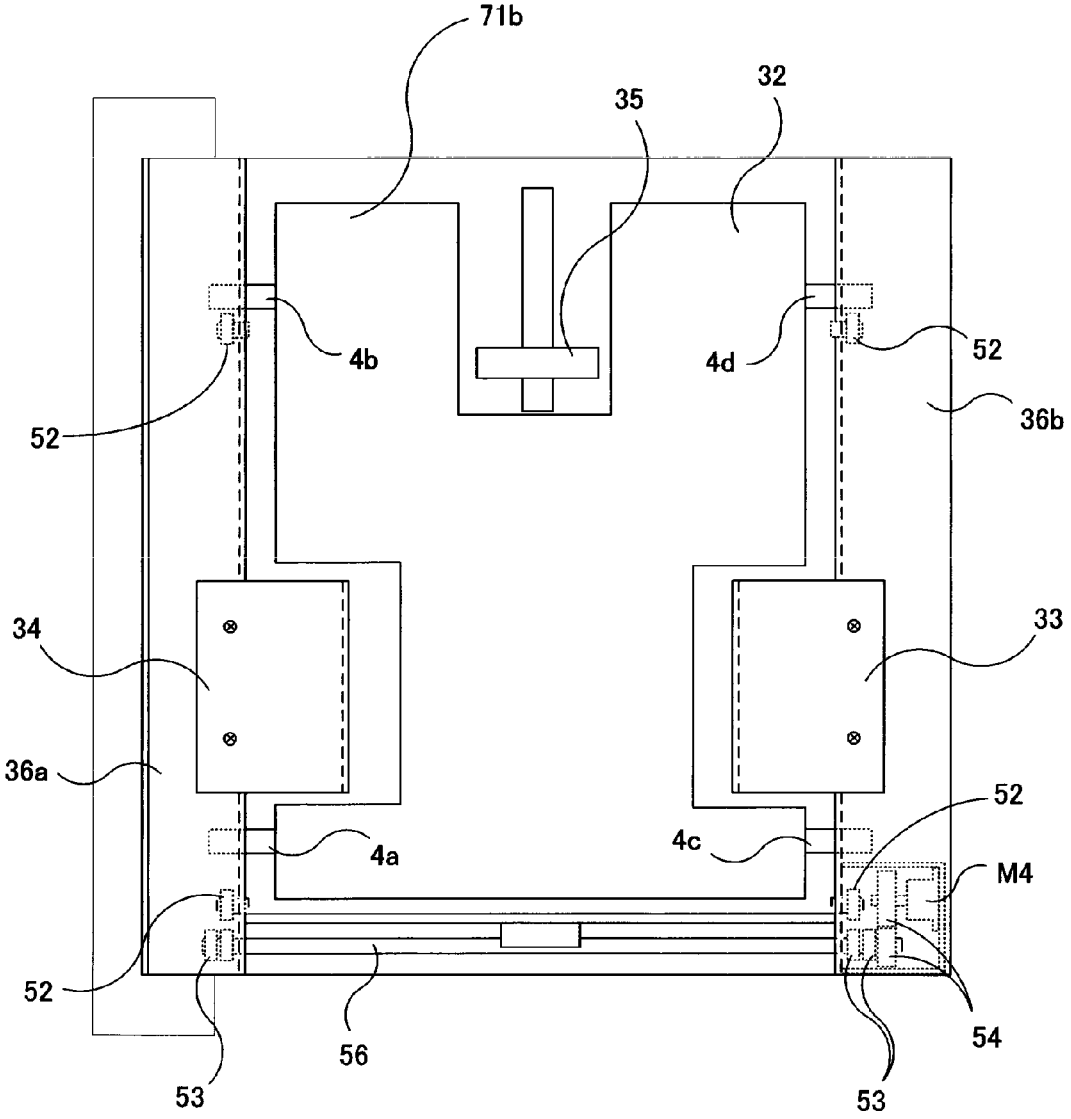
FIG. 4 is a top view of the storage chamber of the sheet feeding apparatus.

FIG. 2 is a sectional view illustrating the sheet feeding apparatus 4. FIG. 3 is a perspective view illustrating a storage chamber 30 arranged in the sheet feeding apparatus 4. FIG. 4 is a top view of the storage chamber 30.

As illustrated in FIG. 2, the sheet feeding apparatus 4 includes the storage chamber 30 that is drawn when sheets are set therein and a sheet feeding mechanism 31 that feeds a sheet in the storage chamber 30. A number of sheets are stacked in the storage chamber 30. The storage chamber 30 is provided with a stack tray 32 that is lifted and lowered in the vertical direction, regulating plates 33, 34 that regulate sheet positions in a width direction, a tailing end regulating plate 35 that regulates a sheet tailing end position, and a lifting-lowering mechanism that lifts and lowers the stack tray 32. Further, the sheet feeding apparatus 4 is provided with a sheet upper-face detecting mechanism 38 as a sheet upper-face detecting device to detect a position of the upper most face of the stacked sheets.

The stack tray 32 is a board-shaped plate on which sheets are stored in the storage chamber 30. An opening elongated in the vertical direction is formed at each side portions 36*a*, 36*b* of a frame body 36. Support portions 4*a*, 4*b*, 4*c*, 4*d* protruded sideward respectively through the openings of both of the side portions 36*a*, 36*b* of the frame body 36 are arranged at both sides in the sheet width direction of the stack tray 32. The support portions 4*a*, 4*b*, 4*c*, 4*d* are supported by the lifting-lowering mechanism that is arranged at outer faces of the side portions 36*a*, 36*b* of the frame body 36, so that the stacked sheets are lifted and lowered by driving of the lifting-lowering mechanism approximately in the horizontal state.

As illustrated in FIGS. 2, 3, and 4, the lifting-lowering mechanism includes four wires 55 that are fixed respectively to the four support portions 4*a*, 4*b*, 4*c*, 4*d* arranged at both side portions of the stack tray 32, a plurality of pulleys 52 to which the four wires 55 are routed, four winding pulleys 53 that reels the four wires 55 as being attached to a single shaft, a plurality of drive gears 54 for driving the four winding pulleys 53, and a lifting-lowering motor M3 that drives the winding pulleys 53 through the drive gears 54. When the lifting-lowering motor M3 is driven to be rotated forwardly, the four winding pulleys 53 are rotated to wind up the wires 55 respectively. Accordingly, the four support portions 4*a*, 4*b*, 4*c*, 4*d* of the stack tray 32 are concurrently lifted, so that the stack tray 32 are lifted as being maintained approximately in the horizontal state. On the other hand, when the lifting-lowering motor M3 is driven to be rotated reversely, the winding pulleys 53 are rotated in the opposite direction, so that the stack tray 32 is lowered under its own weight in the horizontal state.

The sheet feeding mechanism 31 includes a feeding roller 40 that feeds a sheet as being contacted to an uppermost face of stacked sheets, a separating device that separates the fed sheet one by one, and a conveying roller pair 43 that conveys the sheet separated by the separating device to the image forming apparatus 1. The separating device includes a sheet feeding roller 41 and a separating roller 42 that prevents feeding of sheets subsequent to the first sheet as being pressure-contacted to the sheet feeding roller 41.

The sheet feeding roller 41 is drive-connected to a sheet feeding motor M1 via a plurality of gears or a timing belt, so that a sheet is fed with rotation of the sheet feeding roller 41 driven by the sheet feeding motor M1. Here, a bracket 44 of the feeding roller 40 is rotatably supported by a shaft of the sheet feeding roller 41. The shaft of the sheet feeding roller 41 is drive-connected to the shaft of the feeding roller 40 via a plurality of gears. Thus, driving of the sheet feeding motor M1 is transmitted to the feed roller 40 via the shaft of the sheet feeding roller 41.

The separating roller 42 is provided with an unillustrated torque limiter at a rotational shaft thereof. According to the above, when two or more sheets are overlapped and nipped at a pressure-contact portion of the sheet feeding roller 41 and the separating roller 42, driving is stopped to prevent the second and subsequent sheets from being fed. When a plurality of sheets are overlapped and fed to the nip portion of the sheet feeding roller 41 and the separating roller 42, a drive force of the sheet feeding roller 41 is transmitted to the uppermost sheet and sliding occurs against the second and subsequent sheets to separate the first sheet from the second and subsequent sheets. Here, it is also possible to use a separating pad instead of the separating roller 42.

The conveying roller pair 43 includes a driving roller that is drive-connected to a conveying motor M2 and a driven roller that is rotated as being driven by the driving roller. Owing to rotation of the driving roller of the conveying roller pair 43 caused by driving of the conveying motor M2, a sheet is supplied from the sheet feeding apparatus 4 to the image forming apparatus 1.

As illustrated in FIG. 3, at the storage chamber 30, a pair of the regulating plates 33, 34 are arranged as being faced to each other at both sides being a front side and a rear side in the drawing direction of the storage chamber 30, that is, at both sides in the sheet width direction being perpendicular to the sheet feeding direction. The pair of regulating plates 33, 34 includes the first regulating plate 33 that regulates one end side of sheets and the second regulating plate (fixed regulating device) 34 that regulates the other end side thereof. The first regulating plate 33 is attached to an upper face of the side portion 36*a* of the frame body 36 of the storage chamber 30 with a fixing member such as screws and the second regulating plate 33 is attached to an upper face of the side portion 36*b* that is faced to the side portion 36*a* with a fixing member. Unillustrated attachment holes (tapped holes) corresponding to sheet sizes are formed respectively at upper faces of the side portions 36*a*, 36*b*. Owing to that the first and second regulating plates 33, 34 are attached to the tapped holes that correspond to a size of sheets to be stored in the storage chamber 30, the first and second regulating plates 33, 34 can be located at positions that correspond to the sheet size.

Figure 5:
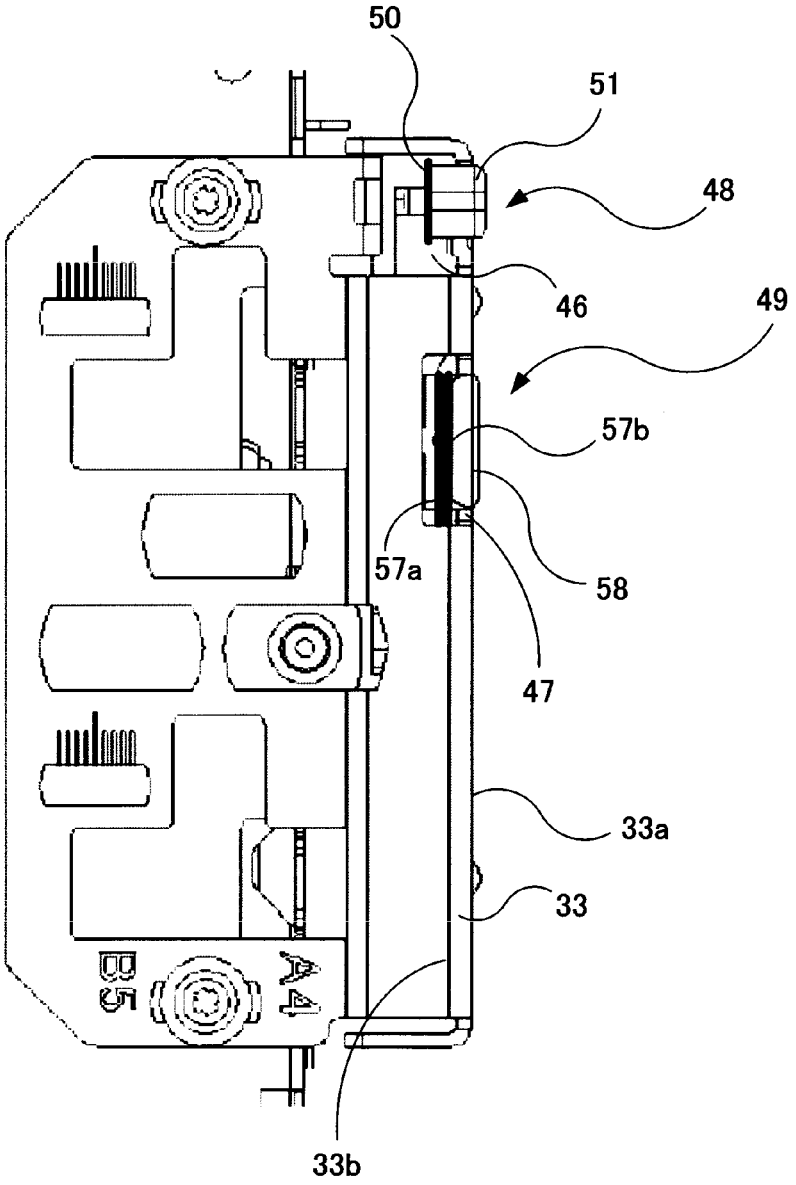
FIG. 5 is a top view illustrating first and second movable regulating mechanisms arranged at a first regulating plate of the sheet feeding apparatus.
Figure 6:
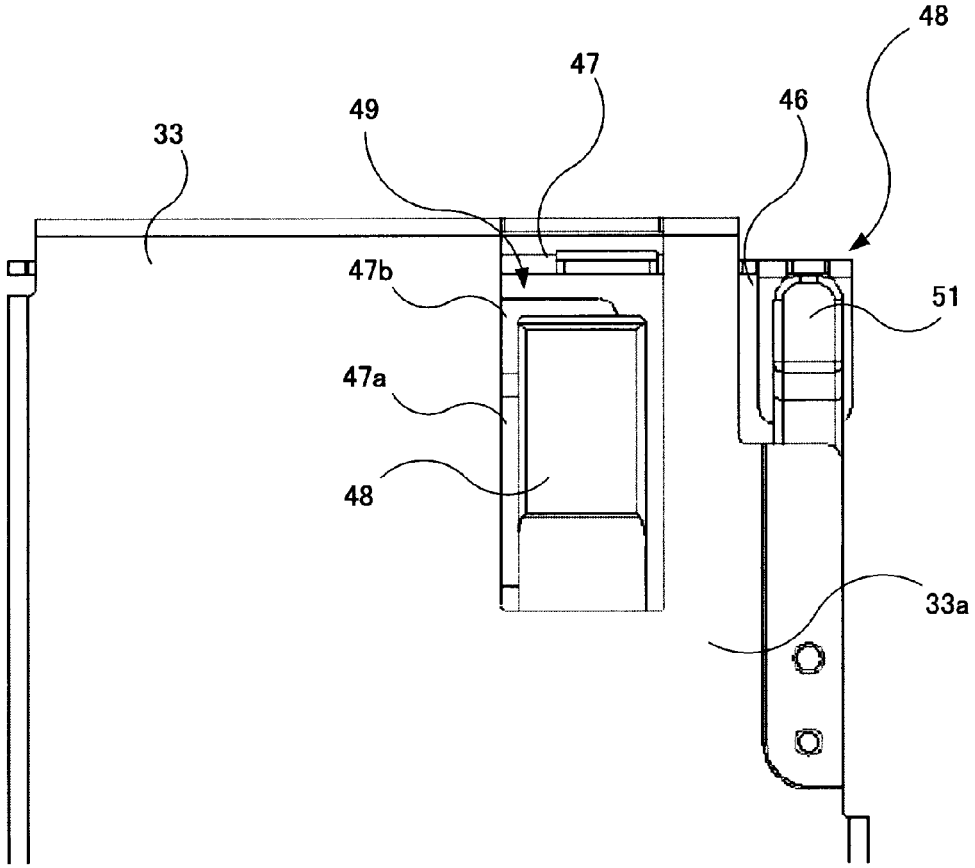
FIG. 6 is a side view illustrating the first and second movable regulating mechanisms arranged at the first regulating plate of the sheet feeding apparatus.
Figure 7:
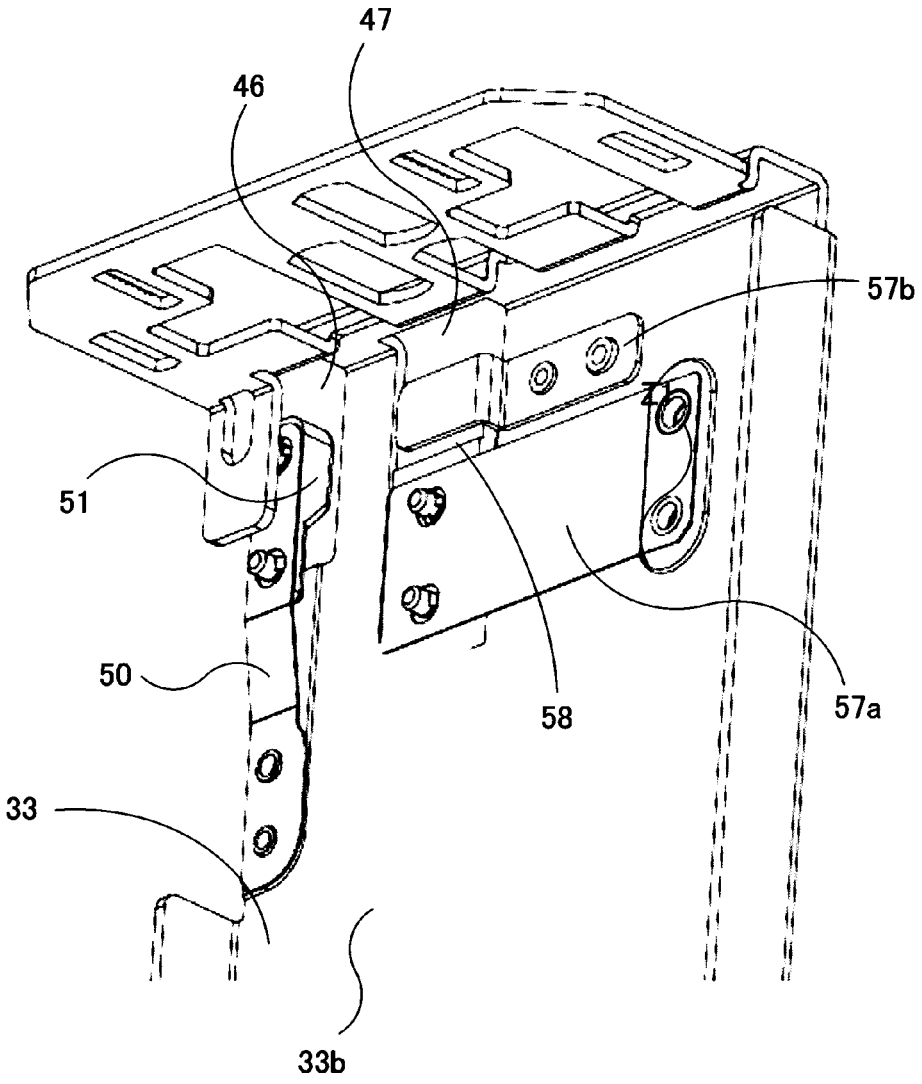
FIG. 7 is a perspective rear view illustrating the first and second movable regulating mechanisms arranged at the first regulating plate of the sheet feeding apparatus.
Figure 8A:
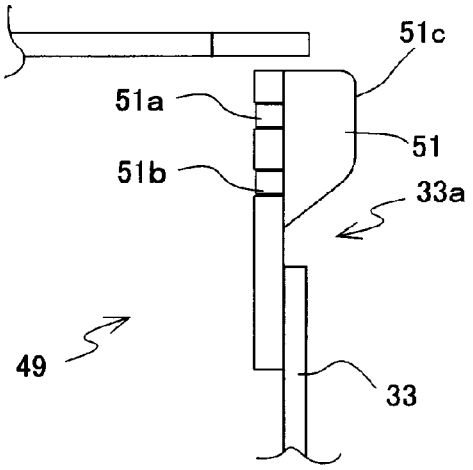
FIGS. 8A and 8B are operational views illustrating operation of a movable regulating device of the first regulating mechanism arranged at the first regulating plate.
Figure 8B:
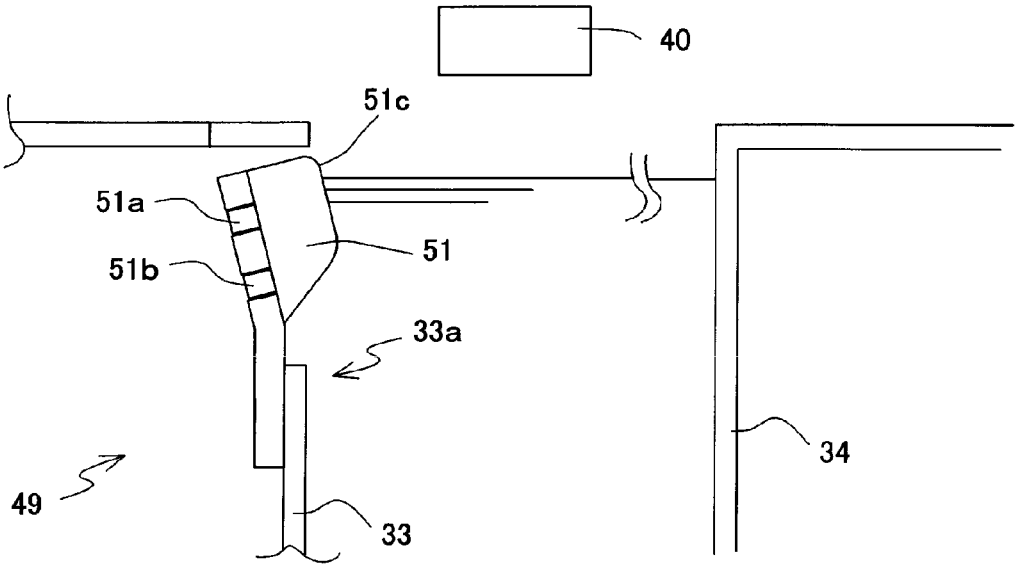

Further, the first regulating plate 33 is provided with a first movable regulating mechanism 48 and a second movable regulating mechanism 49 that press end parts of sheets stacked on the stack tray 32. FIGS. 5 to 7 are views illustrating a main part of the first regulating plate 33 to which the first and second movable regulating mechanisms 48, 49 are attached. FIG. 5 is a top view, FIG. 6 is a side view, and FIG. 7 is a perspective rear view. FIGS. 8A and 8B are operational views illustrating operation of the first movable regulating mechanisms 48.

As illustrated in FIGS. 5 to 7, a first cutout portion 46 is formed at an upper part of the first regulating plate 33 at the downstream side in the sheet feeding direction. The first movable regulating mechanism 48 that includes a first plate spring 50 and a first pressing member 51 as a first urging member is arranged at the first cutout portion 46. As illustrated in FIG. 5, one end side of the first plate spring 50 of the first movable regulating mechanism 48 is attached as being swaged to a rear face 33*b* of the first regulating plate 33 being different from a regulating face 33*a* thereof. A fitting hole is formed at a free end side of the first plate spring 50 being different from a fixed side thereof. The first pressing member 51 is attached by pressure-fitting a pressure-fit pin of the first pressing member 51 to the fitting hole.

As illustrated in FIG. 8A, the first pressing member 51 is arranged so that a pressing face 51*c* thereof is protruded toward the second regulating plate 34 from the regulating face 33*a* of the first regulating plate 33. Further, the first pressing member 51 is arranged at an upper part of stacked sheets and at the downstream side in the feeding direction of the stacked sheets to press and regulate the sheets that are to be fed. That is, as illustrated in FIG. 3, the first pressing member 51 is arranged at the same position as or in the vicinity of the position of the feeding roller 40 in the sheet feeding direction. When the sheets are lifted to a position of the pressing face 51*c* of the first pressing member 51, a pressing face 51*a* protruded toward the second regulating plate 34 is pressed by the sheets in a direction opposite to the protruded direction, as illustrated in FIG. 8B, so that the first plate spring 50 is elastically deformed. An end part of the sheets are pressed with a reactive force (urging force) of the elastic deformation.

Further, a second cutout portion 47 is formed at the first regulating plate 33 at a position being different from the first cutout portion 46. The second cutout portion 47 is formed at a position corresponding to an upper part of the stacked sheets in the vicinity of the upstream in the sheet feeding direction of the first cutout portion 46 to which the first movable regulating mechanism 48 is attached. The second movable regulating mechanism 49 that includes a second plate spring 57*a* and a third plate spring 57*b* as a second urging member and a second pressing member 58 as a second pressing device is arranged at the second cutout portion 47. The second movable regulating mechanism 49 has a structure being similar to the first movable regulating mechanism 48. As illustrated in FIG. 7, one end side of each of the second and third plate springs 57*a*, 57*b* is attached as being swaged to the rear face 33*b* of the first regulating plate 33 being different from the regulating face 33*a* thereof. Further, the second pressing member 58 is attached to the other end side thereof that is arranged as being extended into the second cutout portion 47. Similarly to the first movable regulating mechanism 48, the second pressing member 58 is attached by pressure-fitting a pressure-fit pin of the second pressing member 58 to a fitting hole at the other end side of each of the second and third plate springs 57*a*, 57*b*.

Here, the second movable regulating mechanism 49 presses an end part of sheets under operation similar to the first movable regulating mechanism 48 as illustrated in FIGS. 8A and 8B.

Figure 9:
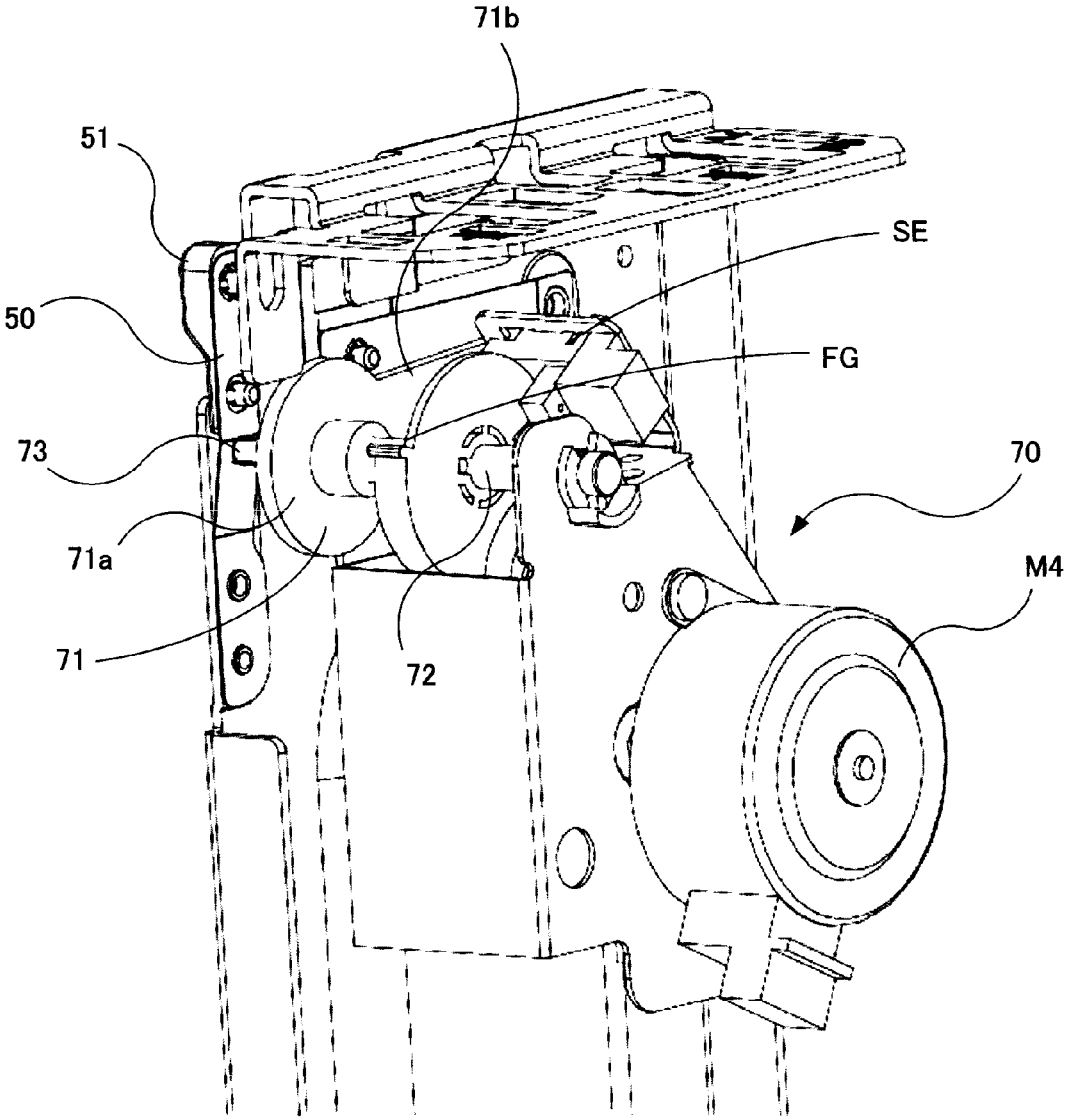
FIG. 9 is a perspective view illustrating an urging force changing mechanism arranged at the first regulating plate.
Figure 10A:
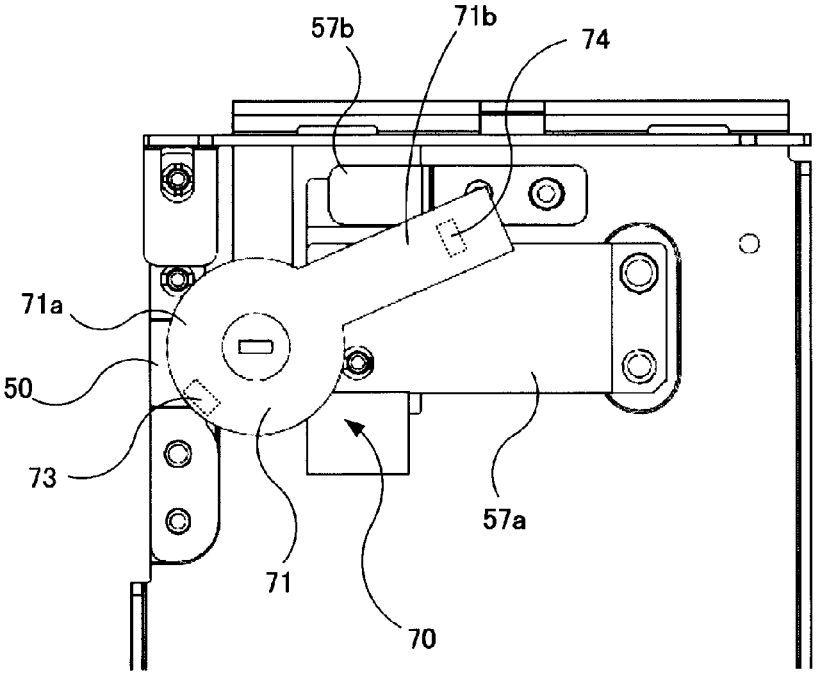
FIGS. 10A and 10B are state views illustrating states of an urging force changing member of the urging force changing mechanism arranged at the first regulating plate.
Figure 10B:
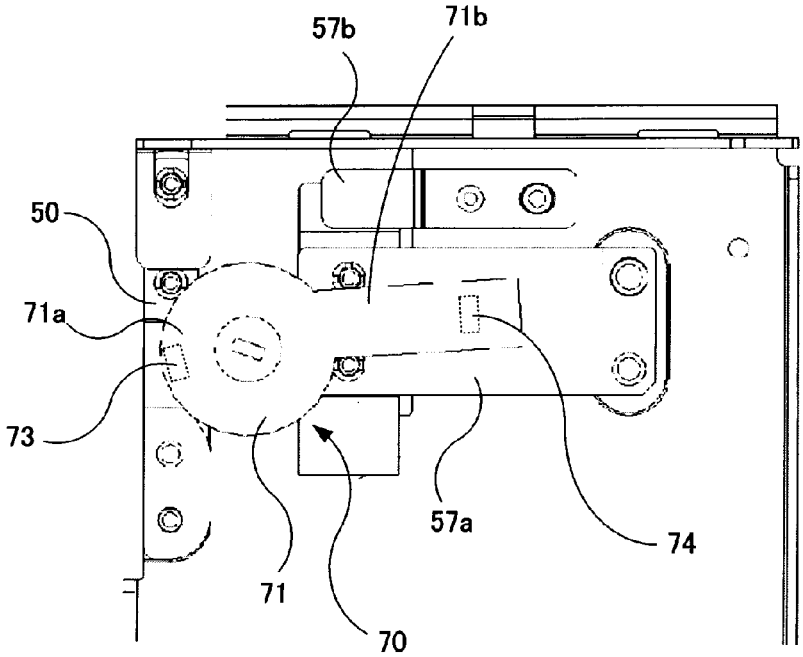

Further, there is arranged an urging force changing mechanism 70 that changes urging forces of the first and second pressing members 51, 58 by switching elastic forces (reaction forces under elastic deformation) of the first and second plate springs 50, 57*a* in accordance with a sheet thickness. FIG. 9 is a perspective view illustrating the urging force changing mechanism 70. FIGS. 10A and 10B are state views illustrating states of an urging force changing member 71 of the urging force changing mechanism 70.

As illustrated in FIGS. 9, 10A, and 10B, the urging force changing mechanism 70 includes the urging force changing member 71 that has a disc-shaped portion 71*a* and a protruded portion 71*b* protruded from the disc-shaped portion 71*a*, a rotational shaft 72 that axis-supports the center of the disc-shaped portion 71*a* of the urging force changing member 71, a drive motor M4 that rotates the urging force changing member 71 via the rotational shaft 72, and first and second gears (not illustrated) that transmit driving of the drive motor M4 to the rotational shaft 72.

A first convex piece 73 is arranged at the disc-shaped portion 71*a* of the urging force changing member 71 and a second convex piece 74 is arranged at the protruded portion 71*b* thereof. The first convex piece 73 is protruded toward the first plate spring 50. Rotation of the urging force changing member 71 causes the first convex piece 73 to be moved to either a separation position being apart from the first plate spring 50 in the rotation direction or a regulation position overlapping to the first pressing member 51 of the first plate spring 50 at a rear face opposite to the face to which the first pressing member 51 is attached. Similarly, the second convex piece 74 is protruded toward the second plate spring 57*a*. Rotation of the urging force changing member 71 causes the second convex piece 74 to be moved to either a separation position being apart from the second plate spring 57*a* in the rotation direction or a regulation position overlapping to the second pressing member 58 of the second plate spring 57*a* at the rear face opposite to the face to which the second pressing member 58 is attached. Here, the first convex piece 73 and the second convex piece 74 are arranged at the disc-shaped portion 71*a* and the protruded portion 71*b* respectively, so as to be moved concurrently to either the separation positions or the regulation positions.

The urging force changing member 71 is rotated by driving of the drive motor M4, so that the first and second convex pieces 73, 74 are moved respectively to either the separation positions or the regulation positions. Then, elastic forces of the first and second plate springs 50, 57*a* are changed by the action described below.

The action of the first and second convex pieces 73, 74 will be described based on FIGS. 10A and 10B. The first and second convex pieces 73, 74 are moved respectively to either the separation positions being apart from the first and second plate springs 50, 57*a* as illustrated in FIG. 10A or the regulation positions being contacted to or in the vicinity of the rear face at free end parts being different from the swaged end parts of the first and second plate springs 50, 57*a* as illustrated in FIG. 10B.

When the first and second convex pieces 73, 74 are located at the separation positions, the first and second plate springs 50, 57*a* are bent having the swaged positions as fulcrums respectively to provide a predetermined reaction force (urging force). On the other hand, when the first and second convex pieces 73, 74 are located at the regulation positions as illustrated in FIG. 10B, the first and second plate springs 50, 57*a* are bent having the positions where the first and second convex pieces 73, 74 are located as fulcrums respectively. Accordingly, compared to when the first and second convex pieces 73, 74 are located at the separation positions, when the first and second convex pieces 73, 74 are located at the regulation positions, each distance from the fulcrum to a load point becomes shorter and the reaction force (urging force) with respect to deflection at the load point becomes larger. Thus, the urging force to press a sheet end part can be changed by changing positions of the first and second convex pieces 73, 74.

In the present embodiment, there is provided a detecting mechanism 76 that detects arrival of the first and second convex pieces 73, 74 at the separation positions and the regulation positions. The detecting mechanism 76 includes a detection flag FG that is attached to the rotational shaft 72 and a photosensor SE including a light emitting portion and a light receiving portion. The detection flag FG and the photosensor SE are set so that the separation position is detected when an optical path from the light emitting portion to the light receiving portion of the photosensor SE is completely blocked by the detection flag FG and the regulation position is detected when the optical path from the light emitting portion to the light receiving portion of the photosensor SE are completely opened.

Figure 11:
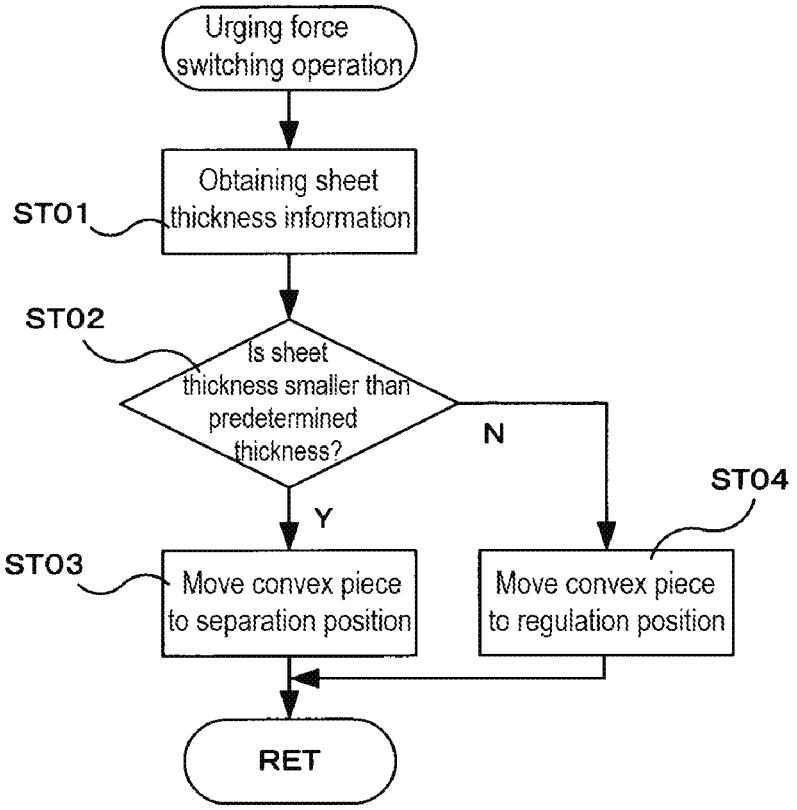
FIG. 11 is a flowchart of switching operation of the urging force changing mechanism of the first regulating plate to switch an urging force.

Next, switching operation to switch the urging force will be described based on a flowchart of FIG. 11. First, sheet thickness information is obtained by a controller 100 serving as an information obtaining device (ST01). Here, the sheet thickness information is received from the image forming apparatus 1 as being a thickness obtained from a sheet kind inputted through an operational panel of the image forming apparatus 1 by an operator. Next, it is determined whether or not the obtained sheet thickness information indicates a sheet thickness being equal to or larger than a predetermined thickness (ST02). When the sheet thickness is smaller than the predetermined thickness, the drive motor M4 is forwardly rotated to move the first and second convex pieces 73, 74 of the urging force changing member 71 to the separation positions (ST03). Here, in the case that the first and second convex pieces 73, 74 have been detected as being at the separation positions by the detecting mechanism 76, the first and second convex pieces 73, 74 are maintained at the separation positions without driving the drive motor M4. On the other hand, when the sheet thickness is equal to or larger than the predetermined thickness, the drive motor M4 is reversely rotated to move the first and second convex pieces 73, 74 of the urging force changing member 71 to the regulation positions (ST04). Here, in the case that the first and second convex pieces 73, 74 have been detected as being at the regulation positions by the detecting mechanism 76, the first and second convex pieces 73, 74 are maintained at the regulation positions without driving the drive motor M4.

Thus, in accordance with the sheet thickness information obtained from the image forming apparatus 1, the first and second convex pieces 73, 74 of the urging force changing member 71 are moved to either the separation positions being apart from the first and second plate springs 50, 57*a* or the regulation positions being at the rear face of the first and second plate springs 50, 57*a*. Accordingly, it is possible, with a simple structure, to easily change the urging force to press a sheet end part. Since the first and second convex pieces 73, 74 are moved to the separation positions when the sheet thickness is small to lessen the urging force of the first and second plate springs 50, 57*a*, the problem that sheets cannot be aligned due to deflection of the sheets can be prevented from occurring. Further, since the first and second convex pieces 73, 74 are moved to the regulation positions when the sheet thickness is large to enlarge the urging force of the first and second plate springs 50, 57*a*, the problem that sheets cannot be aligned due to shortage of the urging force to the sheets can be prevented from occurring.

In the abovementioned embodiment, the urging force changing mechanism 70 is configured to rotate the urging force changing member 71 using the drive motor M4 to move the first and second convex pieces 73, 74 to either the separation positions or the regulation positions. However, it is also possible that the urging force changing member 71 is rotated using an operational lever 79 to move the first and second convex pieces 73, 74 to either the separation positions or the regulation positions.

Figure 12:
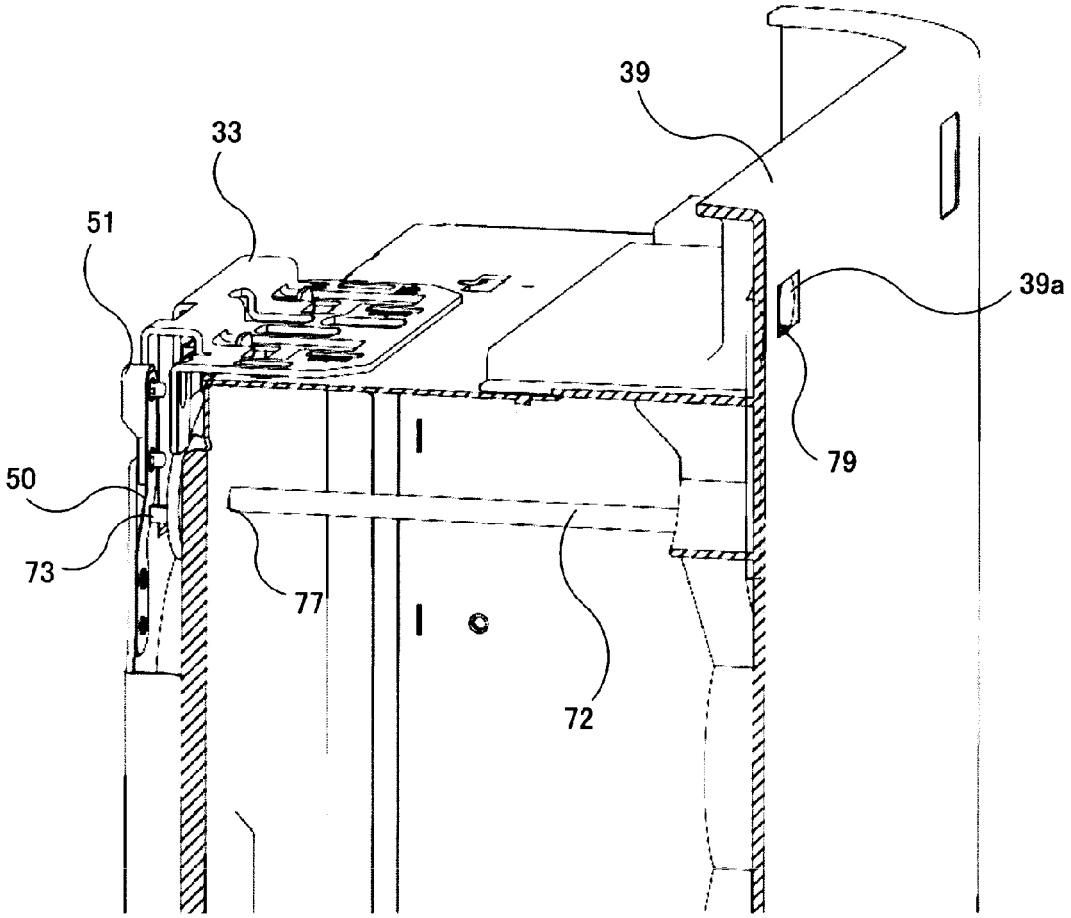
FIG. 12 is a perspective view illustrating a modified example of the urging force changing mechanism.
Figure 13A:
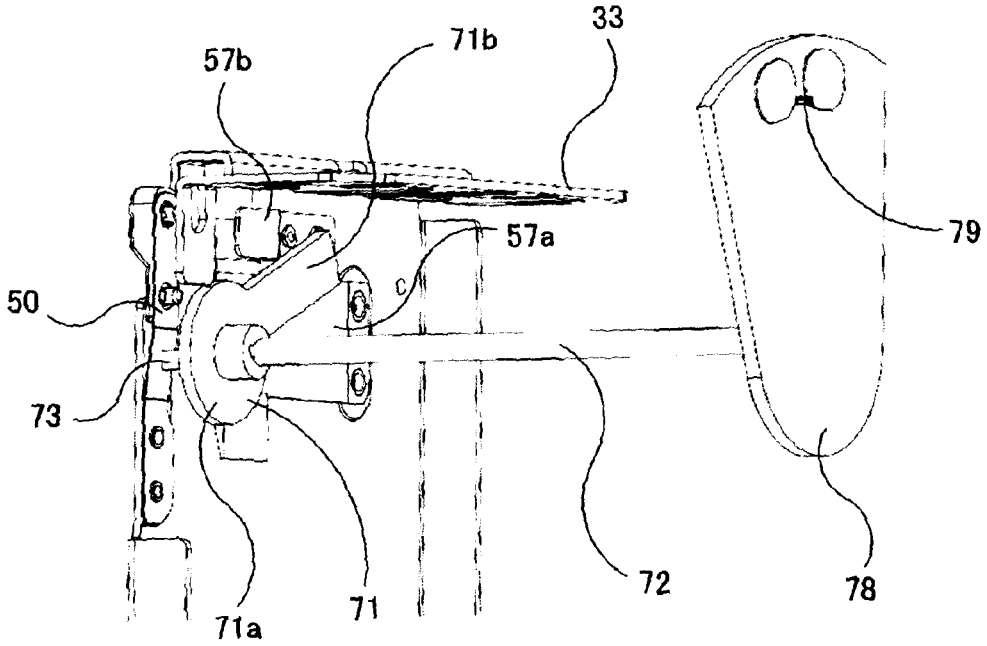
FIGS. 13A and 13B are state views illustrating states of the modified example of the urging force changing mechanism.
Figure 13B:
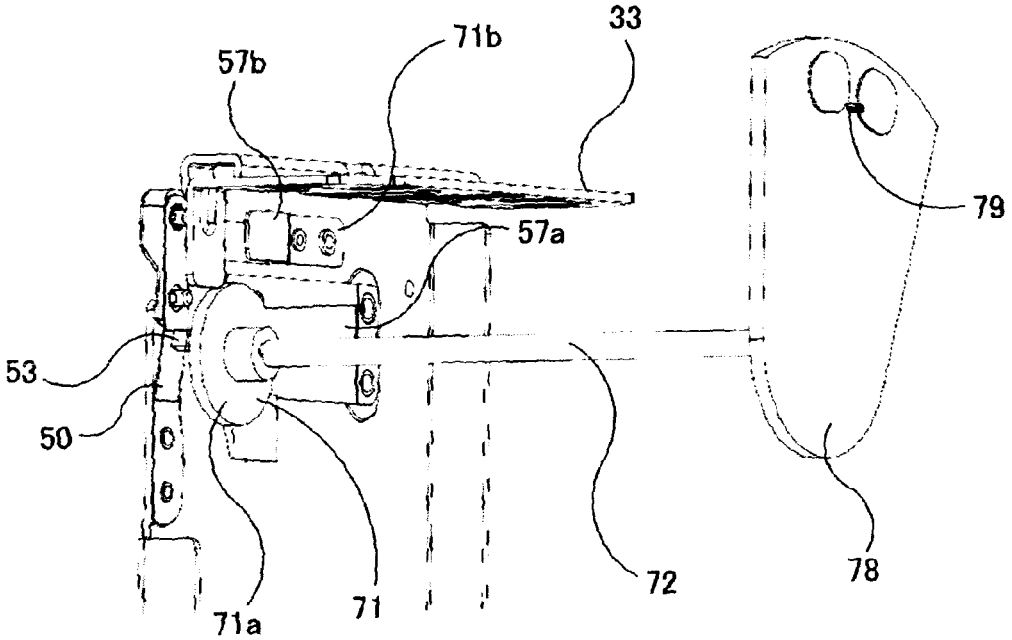

An urging force changing mechanism using the operational lever 79 will be specifically described as a modified example of the abovementioned embodiment. FIG. 12 is a perspective view illustrating a structure of the urging force changing mechanism using the operational lever. FIGS. 13A and 13B are state views illustrating states of the urging force changing mechanism using the operational lever. Here, the same reference is provided for convenience to the same element as in the abovementioned embodiment.

In this modified example, the urging force of the first and second plate springs 50, 57*a* is changed owing to that an operator operates an operational lever 79.

As illustrated in FIG. 12, a rotational shaft 72 of the urging force changing member 71 is extended to a rear face of a front cover 39 of the storage chamber 30 as passing through a through-hole 77 that is formed at the side portion 36*a* of the frame body 36. An operational member 78 is attached to an end part of the rotational shaft 72 on the side of the front cover 39, and then, the operational lever 79 for operating the urging force changing member 71 is arranged at the operational member 78. The operational lever 79 is an operational piece that is protruded in the same direction as the direction in which the rotational shaft 72 is extended. As illustrated in FIG. 12, the operational lever 79 is protruded outward from an exterior face of the front cover 39 through an opening 39*a* that is formed at the front cover 39 so as to be capable of being pinched by an operator. The opening 39*a* of the front cover 39 is formed so that the operational lever 79 can be moved within a predetermined range.

According to such a configuration, when an operator pinches and moves the operational lever 79 that is protruded outward from the front cover 39, the urging force changing member 71 is rotated about the rotational shaft 72 via the operational member 78. Accordingly, as illustrated in FIGS. 13A and 13B, the first convex piece 73 at the disc-shaped portion 71*a* of the urging force changing member 71 and the second convex piece 74 of the protruded portion 71*b* thereof are moved to either the separation positions or the regulation positions. The opening 39*a* is formed in a range enabling to move the first and second convex pieces 73, 74 between the separation positions and the regulation positions. Here, in the case that the first and second convex pieces 73, 74 are located at the separation positions when the operational lever 39 is located at one end part of the opening 39*a* and the first and second convex pieces 73, 74 are located at the regulation positions when the operational lever 39 is located at the other end part of the opening 39*a*, position switching of the first and second convex pieces 73, 74 can be easily performed. Further, it is also possible to provide labels at positions where the operational lever 79 causes the first and second convex pieces 73, 74 to be switched between the separation positions and the regulation positions so as, for example, to indicate "thin sheet" and "thick sheet".

The tailing end regulating plate 35 is movably arranged at a slide groove that is formed at a bottom part of the frame body 36 to regulate a tailing end of sheets stacked on the stack tray 32 as being moved in accordance with a sheet size.

The abovementioned embodiment includes the first movable regulating mechanism 48 and the second movable regulating mechanism 49. However, it is also possible to include only one movable regulating mechanism.

According to the abovementioned embodiment, the movable regulating mechanisms 48, 49 are arranged to perform sheet aligning as pressing sheets located at an upper area among sheets stacked on the stack tray 32. Further, the urging force changing mechanism 70 is arranged to change the urging force of the movable regulating mechanisms 48, 49 for pressing sheet end parts. Since pressing forces of the pressing members 51, 58 are changed by changing the urging forces, sheets can be pressed with an appropriate urging force corresponding to various kinds of sheets. Accordingly, the sheets can be fed in an appropriate posture and sheet feeding malfunction can be prevented.

Here, the urging force changing mechanism 70 switches the elastic forces of the plate springs 50, 57*a* of the movable regulating mechanisms 48, 49 in accordance with a thickness or basis weight of sheets to switch the urging forces of the pressing members 51, 58. Accordingly, even when sheets having a different thickness or different basis weight are stacked, the sheets can be reliably aligned on the stack tray 32, and further, the sheets can be fed in an appropriate posture. Therefore, sheet feeding malfunction can be prevented.

Further, distances from the fulcrums to the load points of the plate springs 50, 57*a* are changed by changing fulcrum positions of the plate springs 50, 57*a* by the convex pieces 73, 74 to switch the elastic forces of the plate springs 50, 57*a*, the urging force of the movable regulating mechanisms 48, 49 can be easily switched with a simple structure.

What is claimed is:

1. A sheet feeding apparatus to feed a sheet, comprising:
- a stack tray on which sheets are stacked;
- a feeding roller that feeds a sheet as being contacted to the sheet on the stack tray;
- a pressing member that presses and regulates one end in a width direction of sheets on the stack tray;
- a regulating member that regulates the other end in the width direction of the sheets on the stack tray as being arranged to face the pressing member;
- a plate spring that urges the pressing member toward the regulating member; and
- an urging force changing mechanism that changes an urging force of the plate spring by changing a distance from a fulcrum of elastic deformation of the plate spring to a point where a load of the plate spring is applied.

2. The sheet feeding apparatus according to claim 1, further comprising an information obtaining portion that obtains information relating to a sheet kind,
- wherein the urging force changing mechanism changes the urging force in accordance with the sheet kind obtained by the information obtaining portion.

3. The sheet feeding apparatus according to claim 1, further comprising an information obtaining portion that receives data relating to a sheet thickness transmitted from an external apparatus and obtains a sheet thickness based on the received data,
- wherein the urging force changing mechanism changes the urging force of the urging member in accordance with the sheet thickness obtained by the information obtaining portion.

4. The sheet feeding apparatus according to claim 1, further comprising an operational member that operates the urging force changing mechanism,
- wherein the urging force changing mechanism changes the urging force of the urging member with respect to a position of the operational member.

5. The sheet feeding apparatus according to claim 1,
- wherein the pressing member is arranged at a position to press a vicinity of an end in the width direction of a position of the sheet to which the feeding roller is contacted.

6. A sheet feeding apparatus to feed a sheet, comprising:
- a stack tray on which sheets are stacked;
- a feeding roller that feeds a sheet as being contacted to the sheet on the stack tray;
- a first regulating member that regulates one end in a width direction of sheets on the stack tray;

a pressing member that presses a part of the one end of the sheets on the stack tray as being arranged at the first regulating member;

a second regulating member that regulates the other end in the width direction of the sheets on the stack tray as being arranged to face the first regulating member;

an information obtaining portion that receives data relating to a sheet thickness, a plate spring that urges the pressing member toward the second regulating member; and an urging force changing mechanism that changes a distance from a fulcrum of elastic deformation of the plate spring to a point where a load of the plate spring is applied in accordance with information obtained by the information obtaining portion.

7. The sheet feeding apparatus according to claim 6, wherein a plurality of the pressing members and a plurality of the plate springs are arranged in the first regulating member, and the urging force changing mechanism changes urging forces of the plurality of plate springs.

8. The sheet feeding apparatus according to claim 6, wherein the plate spring has one end side attached to the first regulating member and the other end side attached to the pressing member.

9. A sheet feeding apparatus to feed a sheet, comprising:

a stack tray on which sheets are stacked;

a feeding roller that feeds a sheet as being contacted to the sheet on the stack tray;

a first regulating member that regulates one end in a width direction of sheets on the stack tray;

a pressing member that presses a part of the one end of the sheets on the stack tray as being arranged at the first regulating member;

a second regulating member that regulates the other end in the width direction of the sheets on the stack tray as being arranged to face the first regulating member;

a plate spring that urges the pressing member toward the second regulating member;

an operational member that is operated in accordance with a thickness of a sheet, and an urging force changing mechanism that changes a distance from a fulcrum of elastic deformation of the plate spring to a point where a load of the plate spring is applied by changing the operational member.

10. The sheet feeding apparatus according to claim 9, wherein a plurality of the pressing members and a plurality of the plate springs are arranged, and the urging force changing mechanism changes urging forces of the plurality of plate springs.

11. The sheet feeding apparatus according to claim 9, wherein the plate spring has one end side attached to the first regulating member and the other end side attached to the pressing member.

* * * * *